US006046419A

United States Patent [19]

Krebs

[11] Patent Number: 6,046,419

[45] Date of Patent: Apr. 4, 2000

[54] SWITCH WITH SEQUENTIALLY OPERATED CONTRACTS

[75] Inventor: Peter Krebs, Mömbris, Germany

[73] Assignee: Heinrich Kopp AG, Germany

[21] Appl. No.: 09/251,615

[22] Filed: Feb. 17, 1999

[30] Foreign Application Priority Data

Feb. 18, 1998 [DE] Germany ..... 298 02 820 U

[51] Int. Cl.[7] ..... H01H 9/00

[52] U.S. Cl. ..... 200/533; 200/448; 200/533

[58] Field of Search ..... 200/1 B, 453–463, 200/520–535, 16 A, 243

[56] References Cited

U.S. PATENT DOCUMENTS

| | | | |
|---|---|---|---|
| 2,360,128 | 10/1944 | Hausler | 74/100 |
| 3,612,793 | 10/1971 | Roeser | 200/448 |
| 4,347,415 | 8/1982 | Falchi | 200/243 X |
| 5,360,954 | 11/1994 | Bruggeman et al. | 200/524 |
| 5,569,890 | 10/1996 | Olsen | 200/16 A |
| 5,684,280 | 11/1997 | Franz et al. | 200/16 R |

FOREIGN PATENT DOCUMENTS

| | | | |
|---|---|---|---|
| 27 51 197 | 11/1977 | Germany | H01H 15/22 |
| 42 33 520 C1 | 10/1992 | Germany | H01H 19/62 |
| 43 01 192 C1 | 1/1993 | Germany | H01H 13/26 |
| 44 45 339 A1 | 12/1994 | Germany | H02P 3/06 |

OTHER PUBLICATIONS

German Patent Office Search Report; German Utility Model Registration No. 298 02 820.4, dtd Nov. 11 1998.

*Primary Examiner*—J. R. Scott
*Attorney, Agent, or Firm*—Myers Bigel Sibley & Sajovec

[57] ABSTRACT

A device for turning an electric motor on and off implements an expedient instantaneous turn-on or turn-off switching operation in which contact bridges are released for closing or pushed open by means of a spring-operated over-center device. Pivoting elements are rotated by means of the switching slide via their articulated legs such that, when the dead-center position, which is located between the axes of the pivoting elements, is overcome, one pivoting element axis is shifted in a quick-action motion. As a result of the contact bridge control levers, which are provided in different angular positions on the respective pivoting elements, a sequential switching of two contact bridges can be implemented such that initially the first contact bridge and then the second contact bridge are released for closing under the action of the contact closing spring while for opening initially the second and then the first contact bridge may be pushed open in opposition to the contact closing spring.

18 Claims, 8 Drawing Sheets

SWITCH WITH SEQUENTIALLY OPERATED CONTRACTS

FIELD OF THE INVENTION

BACKGROUND OF THE INVENTION

The present invention relates to a device for turning an electric motor an and off, in particular in a power tool, preferably with housing dimensions in compliance with European standards.

For the operation of power tools press switches are known already which serve to effect switching by means of a control element in opposition to the force of a spring effective in the turn-off direction. The control element is used to turn on the current for the electric motor of the power tool by means of a mobile contact bridge closing respective pairs of terminal contacts.

In the prior art appliance switches of this type the contact pressure depends on a predetermined travel of the control element or the pusher stroke, respectively. What has turned out to be inexpedient in these devices is the fact that insufficient or slow pressure for turning on the appliance switch a contact pressure is created which is too low and which results in a high contact consumption and hence in premature wear. When the appliance is turned off high contact consumption occurs, too, as a result of an electric arc when the contact pressure, which decreases until the contacts are opened, persists for a moment during opening.

SUMMARY OF THE INVENTION

The invention is now based on the problem of providing a device of the general type mentioned by way of introduction, wherein the contact pressure is independent of the switching operation.

In accordance with the invention this problem is solved by the features defined in Patent claim 1. Preferred features for an expedient improvement of the invention are disclosed in the following patent claims.

The inventive design of the device implements an expedient instantaneous turn-on or turn-off switching operation in which the contact bridges are released for closing or pushed open by means of a spring-operated over-center device. The arrangement is made in a way that by means of the switching slide the pivoting elements are rotated via their articulated legs in a way that when the dead-center position, which is located between the axes of the pivoting elements, is overcome one pivoting element axis is shifted in a quick-action motion. As a result of the contact bridge control levers, which are provided in different angular positions on the respective pivoting elements, a sequential switching of two contact bridges can be implemented in the form that initially the first contact bridge and then the second contact bridge are released for closing under the action of the contact closing spring whilst for opening initially the second and then the first contact bridge may be pushed open in opposition to the effect of the contact closing spring.

In accordance with a preferred further embodiment of the invention, the contact bridges are pivotable via a pivot support provided on a terminal, with the contact bridges being preferably retained in opposing pivot supports by means of a joint contact pressure closing spring. This arrangement furnishes an extraordinarily compact configuration of the device with a small number of elements.

According to a preferred further embodiment of the invention the axes of each pivoting element may be shifted in contour areas on the housing side, with the supporting contour for the contact bridge closing first and opening later being configured for an axial displacement which is comparatively smaller than the supporting contour for the other contact bridge.

In accordance with a preferred design of the invention provisions are made for engagement of the control leg of the contact bridge closing first and opening later at a bearing leg of the contact bridge in the OFF position whilst, upon a pivoting motion of the pivoting element for closing the associated pair of contacts, it releases this bearing leg for closing by the contact closing spring or pushes it open for opening, respectively.

Furthermore provisions are made for the control leg to engage the second contact bridge closing later and opening earlier via a pin in the OFF position, with the pin, upon a shift of the axis of the first pivoting element, releasing, in a quick-action motion, the second contact bridge for closing by the contact closing spring or hits it open for opening, respectively, when the slide operation is continued, as a result of the axial shift of the second pivoting element.

BRIEF DESCRIPTION OF THE DRAWINGS

The invention will now be described in the following in more details with reference to the attached drawing.

In the drawings.

DETAILED DESCRIPTION OF THE PREFERRED EMBODIMENT

FIGS. 1 to 8 illustrate a device for turning an electric motor on and off, in particular in a power tool, in the form of a switch 10 with two contact bridges 11 and 12 for two terminal contact pairs 13, 14 and 15, 16 which are accommodated in an electrically insulated housing 17.

Figure 1:
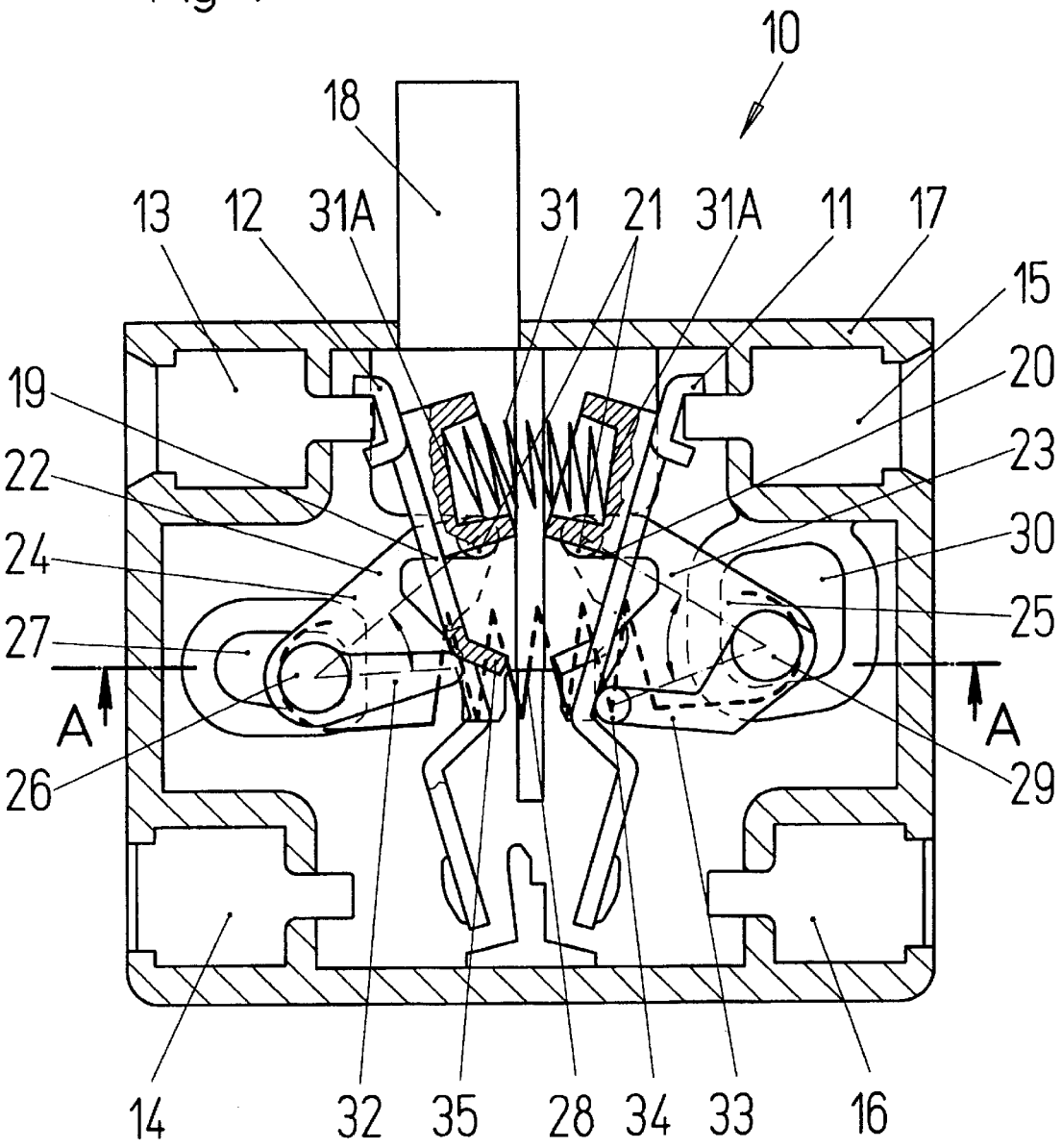
FIG. 1 shows one embodiment of an inventive device with two pairs of terminal contacts.
Figure 2:
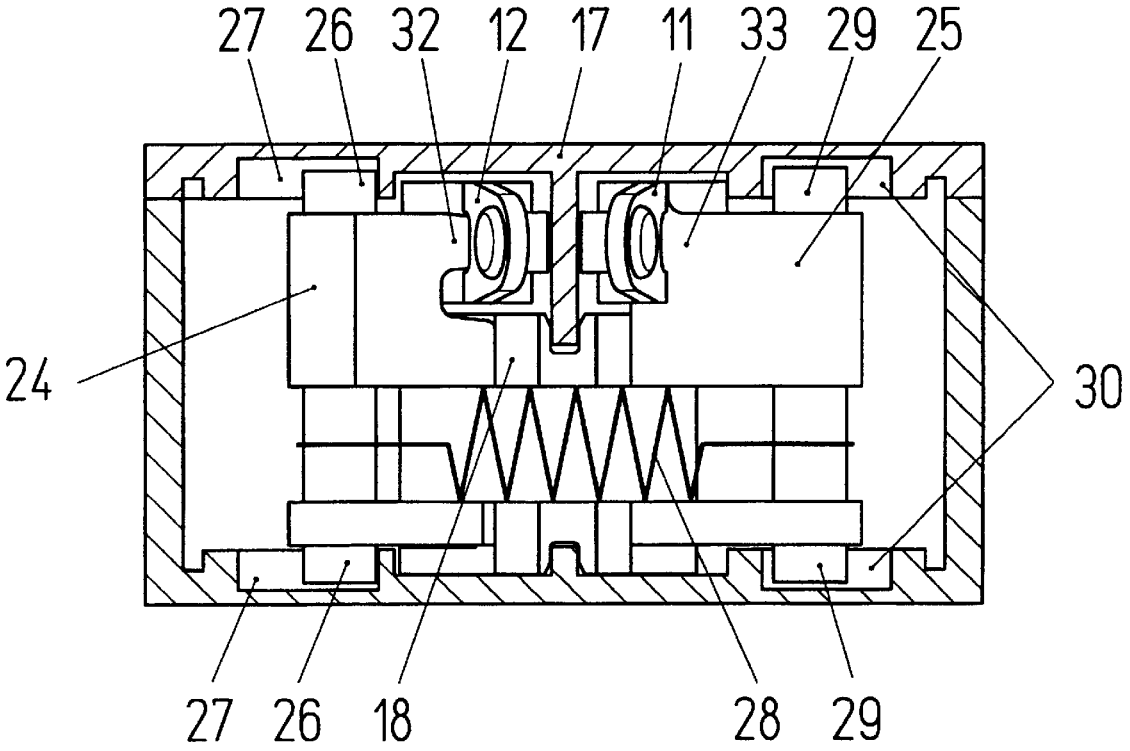
FIG. 2 is a sectional view along the line A—A in FIG. 1.

The reference numeral 18 denotes a switching slide which is slidably guided in the housing and biased into the OFF position shown in FIG. 1 in a manner not illustrated here. The switching slide 18 presents a substantial widening inside the housing 17, as may also be seen in FIG. 2, and is provided with indentations 19 or 20, respectively, in which pins 21 are articulated. The pins 21 are integrally formed on the ends of legs 22 or 23 in a bent position, which are associated with a first pivoting element 24 and a second pivoting element 25. The pivoting element 24 is provided with a pivoting axis 26 which is supported loosely for pivoting motion in recesses 27 on the housing side, as is apparent from FIG. 2.

The recesses 27 form a bearing contour area resembling an enlarged elongate hole, which allows for a lateral, slightly rising deviation of the bearing axes 26 against the action of a tension spring 28 which is articulated by its other end to the bearing axis 29 of the pivoting element 25. The pivoting element 25 in its turn is loosely supported in bearing contour regions 30 on the housing side by its projecting axes 29. The areas 30 have approximately twice the area of the bearing regions 27 and a configuration approximating the shape of an equilateral lozenge.

The contact bridges 11 and 12 are retained by their upper ends at the contacts 15 or 13, respectively, for pivoting motion, by a single contact closing spring 31. The ends of the spring 31 are retained in recesses 31A in the contact bridges 11 and 12.

Moreover, a control leg 32 is integrally formed on the first pivoting element 24 in a first pivoting angle x relative to the pin 21 whose end engages at a leg 35 of the first contact bridge 12 for holding the contact open in the position shown in FIG. 1. A control leg 33 with a bearing pin 34 bent at the end is integrally formed on the second pivoting element 25, with the bearing pin 34 being rotated through an angle $\beta$ about the pivoting axis 29 relative to the pin 21, with the angle $\beta$ being wider than the angle $\alpha$.

Figure 3:
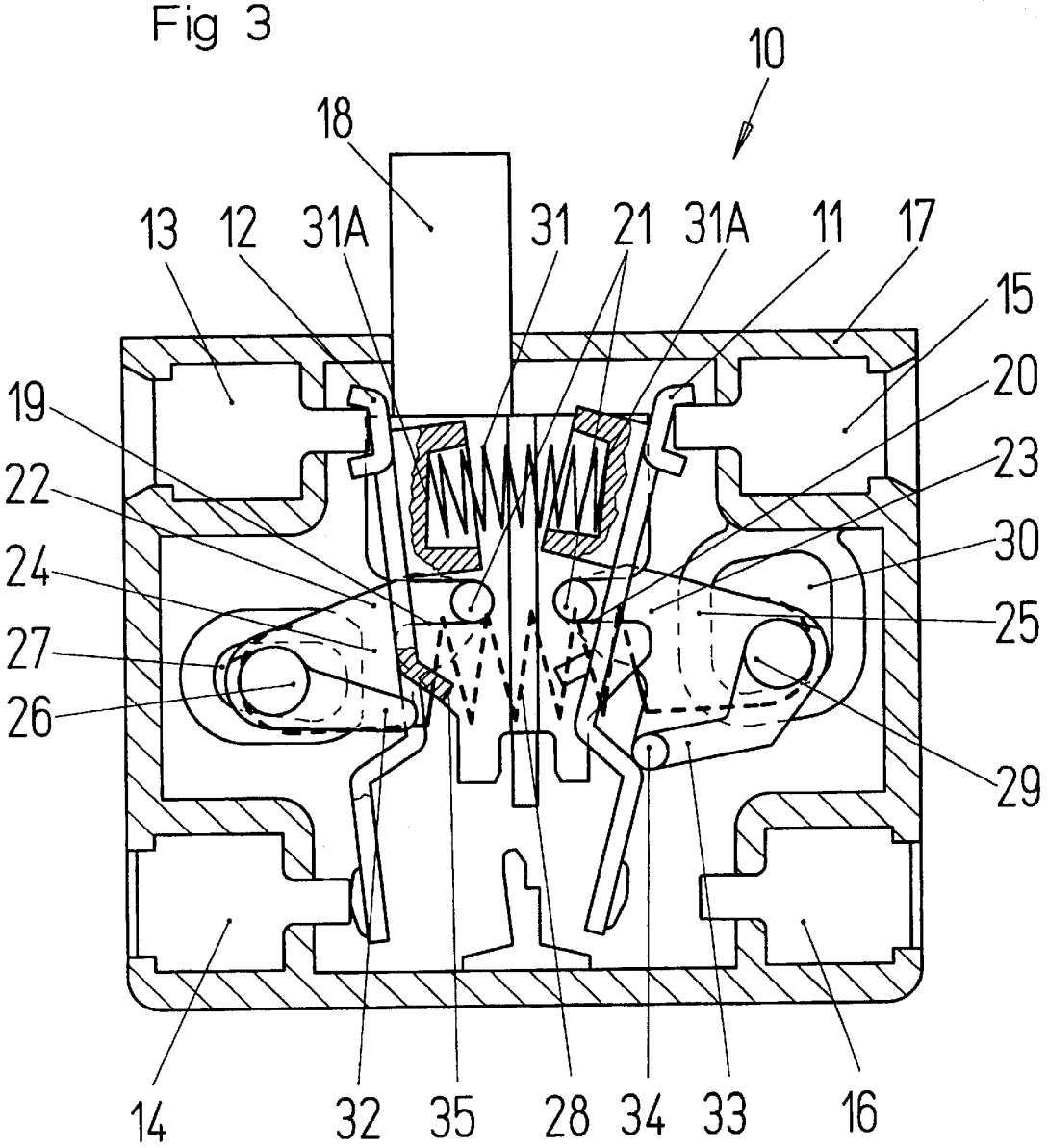
FIG. 3 illustrates the device according to FIG. 1 after a turn-on travel through 2 mm.
Figure 4:
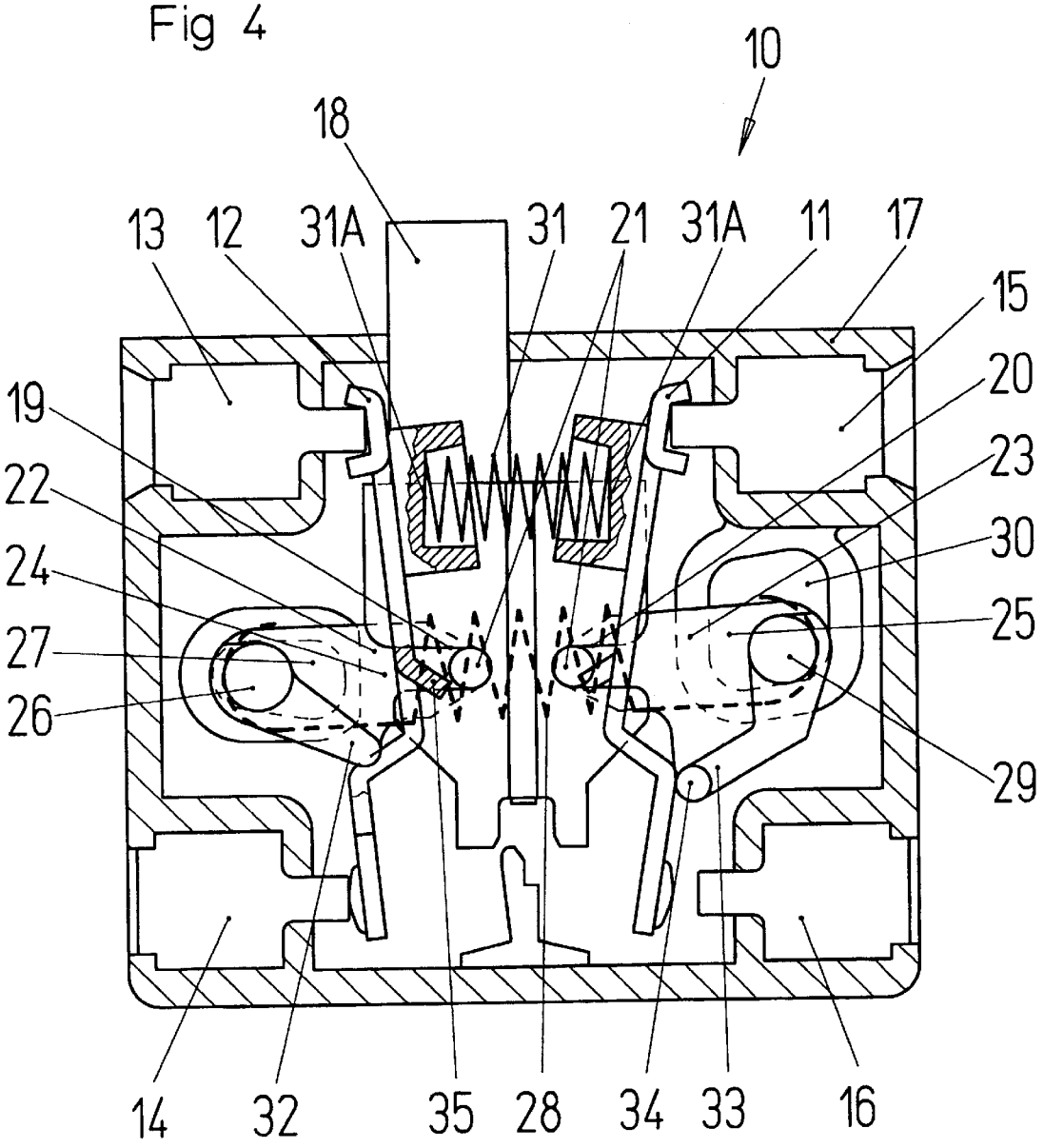
FIG. 4 illustrates the device according to FIG. 1 after a turn-on travel through 4.5 mm briefly before the quick-action shift of the pivoting axis of the right-hand pivoting element.
Figure 5:
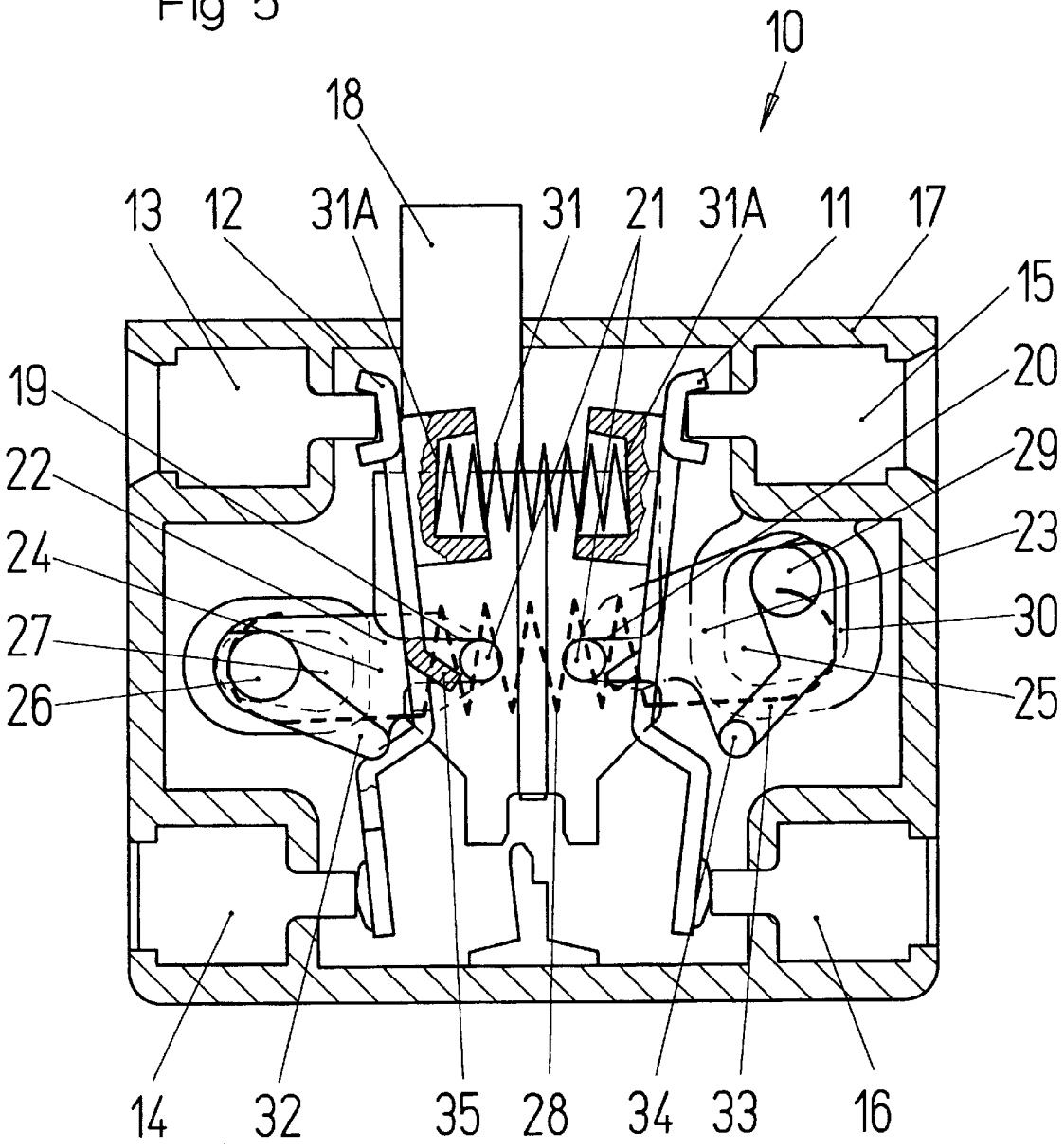
FIG. 5 is a view of the device according to FIG. 1 in the first phase of the turn-on position.
Figure 6:
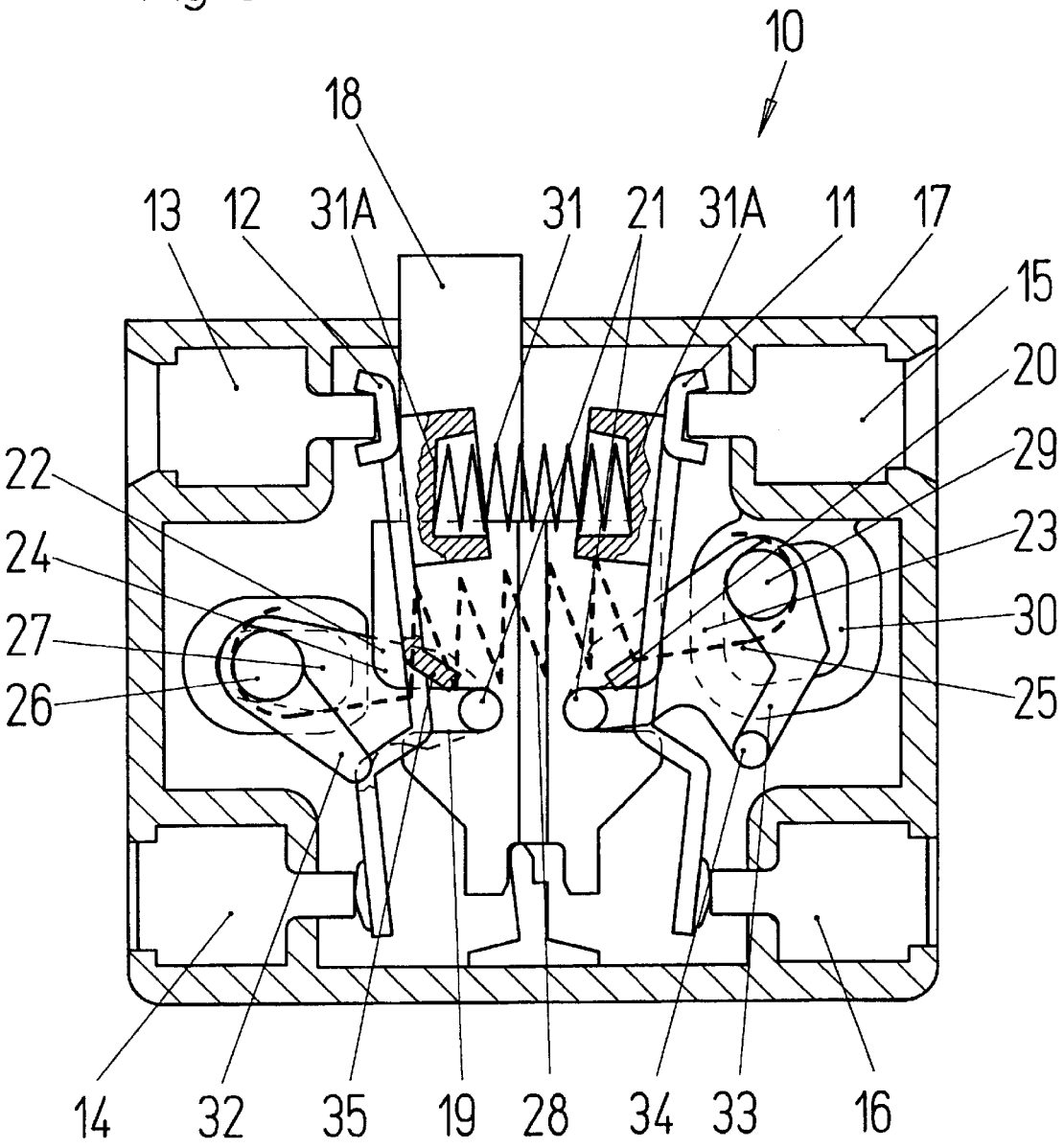
FIG. 6 shows the device according to FIG. 1 in the final ON position.
Figure 7:
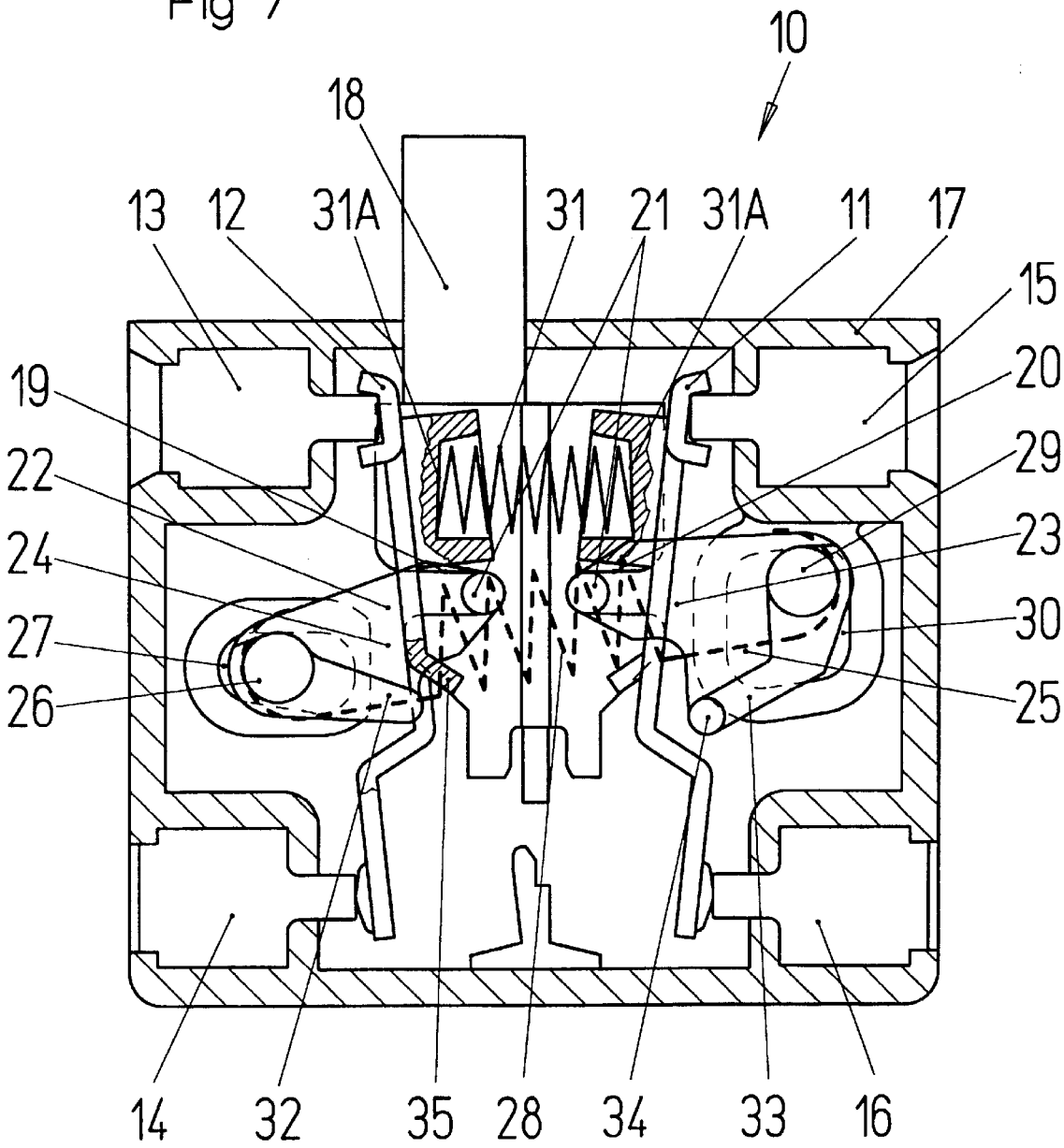
FIG. 7 is a view of the device according to FIG. 6 after a turn-off movement with a travel of 2 mm before the quick-action change of the bearings of the right-hand pivoting element axis.

FIGS. 3 to 6 illustrate different phases of the turn-on operation, with the switching slide 18 being pressed in by only 2 mm approximately in FIG. 3 and with the contact bridge 12 bearing already against the contact 14. This turn-on position has been reached by the switching slide 18 having shifted the axes 26 and 29 with simultaneous outward pivoting and continuing biasing of the tension spring 28, with the control leg 32 having released the leg 35 of the switching contact bridge 12. When the operation of the switching slide 18 is continued in correspondence with FIG. 4 the pivoting axes 26 and 29 are pushed outwards still further, with the pins 21 then passing through the dead center between the two pivoting axes 26 and 29, with the consequence that the pivoting axis 29 jumps in an upward direction in correspondence with FIG. 5 whereupon the pin 34 releases the second contact bridge 11 for contact closing. In the following phase of operation the device then passes into the ON position illustrated in FIG. 6, where the pins 21 have reached the lower-most position and the pivoting axis 29 has undergone a corresponding inward shift due to the action of the tension spring 28.

Figure 8:
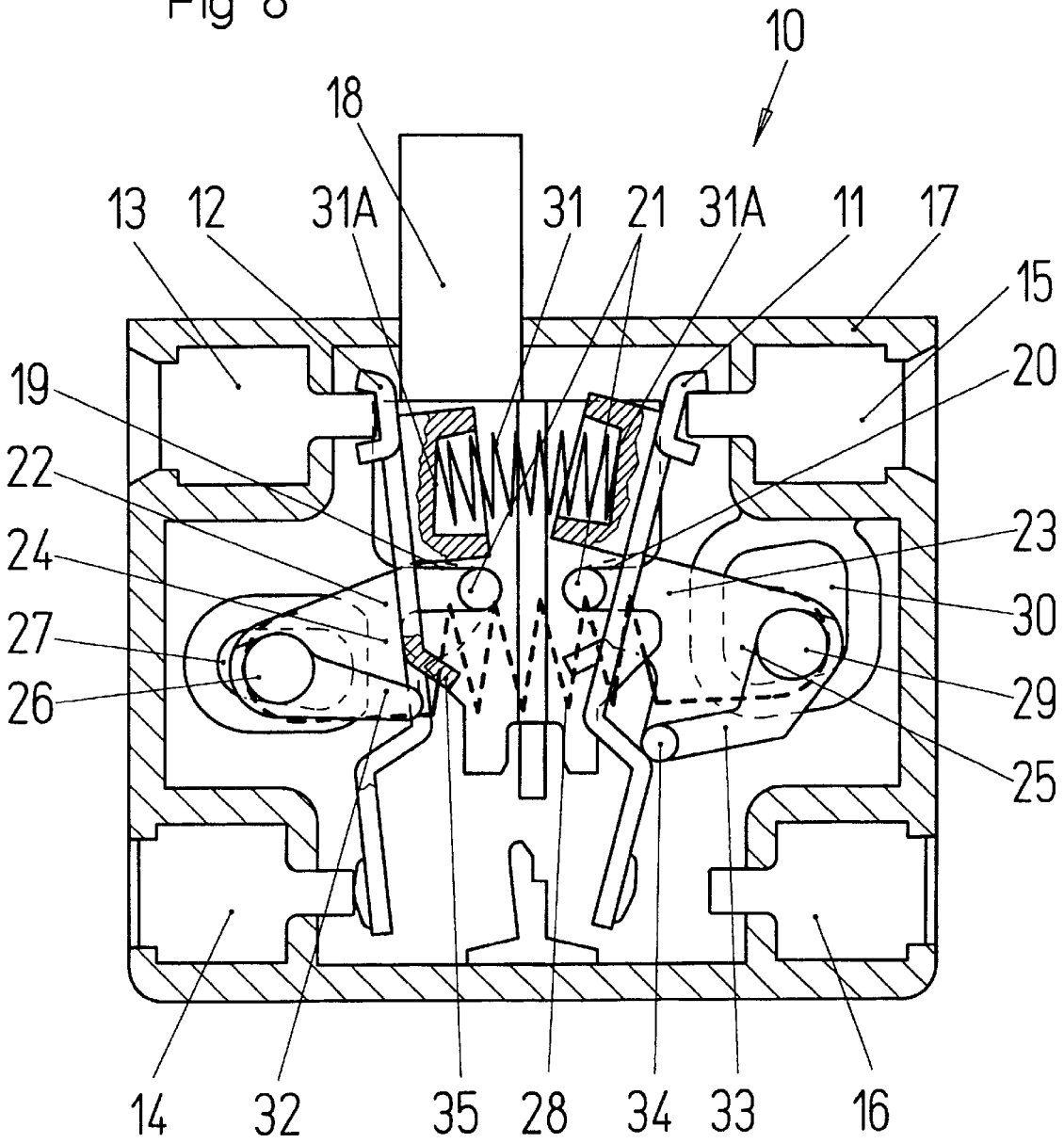
FIG. 8 illustrates the device according to FIG. 7 after the quick-action change of the right-hand pivoting element axis and hitting of the second contact bridge.

When the switching slide 18 is released the pins 21 pass again through the dead center position between the axes 26 and 29, after an initial travel of roughly 2 mm, whereupon, in correspondence with FIG. 8, the axis 29 jumps downward and pushes the contact bridge 11 open. During a continuing opening movement the control leg 32 of the first pivoting element 24 then hits against the bent leg 35 of the first contact bridge 12, thus pushing the first contact bridge 12 open, whereupon the OFF position according to FIG. 1 will have been reached again.

What is claimed is:

1. A device for turning an electric motor on and off, in particular in a power tool, comprising:

a housing;

at least two pairs of closable terminal contacts disposed in said housing and in a mutually isolated arrangement;

a pair of pivotable contact bridges disposed in said housing, each of said contact bridges arranged and configured to close a respective one of said contact pairs and being biased in a closing direction by a contact closing spring;

a switching slide disposed in and slidably guided in said housing, said switching slide biased into an OFF position;

a pivoting element provided for each contact bridge, each of said pivoting elements having a pivoting axis guided for displacement in said housing and connected to a tension spring, wherein said pivoting elements present a contact bridge control leg in different angular positions; and wherein, said switching slide is operable to pivot said pivoting elements such that said contact bridges can be released in succession and closed by said contact closing spring by quick-action displacement of at least one axis of rotation of said pivoting elements, and can be pushed open in opposition to said contact closing spring.

2. Device according to claim 1 wherein said contact bridges are movable about a pivoting support provided on a terminal.

3. A device according to claim 1 wherein said contact bridges are retained on mutually opposing pivoting bearings by a common contact closing spring configured as a compression loaded spring.

4. A device according to claim 1 including recesses in the housing, each said recess defining a contour area and wherein the axes of rotation of said pivoting elements are shiftable in respective ones of said contour areas.

5. A device according to claim 4 wherein:

the axis of rotation of the contact bridge opening first and closing later is shiftable a lesser amount in its respective contour area than the axis of rotation of the other contact bridge is shiftable in its respective contour area.

6. A device according to claim 1 wherein said control leg for the contact bridge closing first and opening later engages at a bearing leg of said contact bridge in the OFF position and releases same upon a pivoting motion of said pivoting element.

7. A device according to claim 1 wherein said control leg for the second contact bridge opening later and closing earlier engages on this bridge via a pin in the OFF position, which pin releases said second contact bridge after a quick-action displacement of the axis of rotation of said second pivoting element.

8. A device according to claim 1 wherein said second pivoting element comprises a pin on the end of its leg and is quick action pivotable about said pin in a recess in the housing after passage through the dead center position defined between the axes of rotation of said two pivoting elements.

9. A device for turning an electric motor on and off, said device comprising:

a) a housing;

b) first and second pairs of terminal contacts disposed in said housing and in mutually isolated arrangement;

c) first and second contact bridges pivotably mounted in said housing, said first contact bridge biased to close said first pair of terminal contacts and said second contact bridge biased to close said second pair of terminal contacts;

d) a switching slide slidably mounted in said housing and selectively movable between an ON position and an OFF position;

e) first and second pivoting elements disposed in said housing, said first pivoting element being pivotable about a first axis and having a first slide leg engaging said switching slide and a first control leg engaging said first contact bridge, said second pivoting element being pivotable about a second axis and having a second slide leg engaging said switching slide and a second control leg engaging said second contact bridge, wherein said first and second axes are moveable in said housing, wherein said first slide leg, said first axis and said first control leg define a first angle and said second slide leg, said second axis and said second control leg define a second angle, said first angle being different than said second angle; and f) a spring mounted in said housing and biasing said first and second control legs into engagement with said first and second contact bridges, respectively;

g) wherein, when said switching slide is moved from said OFF position to said ON position, said first and second pivoting elements are pivoted about said first and second axes and said first and second axes are quickly displaced with respect to said housing such that said first pivoting element allows said biased first contact bridge to close said first pair of terminal contacts and thereafter said second pivoting element allows said biased second contact bridge to close said second pair of terminal contacts;

h) wherein, when said switching slide is moved from said ON position to said OFF position, said first and second pivoting elements force said first and second contact bridges to open said first and second pairs of terminal contacts in succession.

10. The device of claim 9 wherein, when said switching slide is moved from said ON position to said OFF position, said second pivoting element forces said second contact bridge to open said second pair of terminal contacts prior to said first pivoting element forcing said first contact bridge to open said first pair of terminal contacts.

11. The device of claim 9 wherein said first contact bridge is pivotable about one of said first pair of contact terminals and said second contact bridge is pivotable about one of said second pair of contact terminals.

12. The device of claim 9 wherein said first and second contact bridges are biased to close said first and second pairs of contact terminals by at least one contact closing spring.

13. The device of claim 12 including opposed pivot bearings, wherein said first and second contact bridges are retained on said pivot bearings and biased by a common contact closing compression loaded spring.

14. The device of claim 9 including first and second recesses defining first and second contour areas in said housing, wherein said first and second axes are shiftably positioned in said first and second contour areas, respectively.

15. The device of claim 14 configured such that said first axis may be shifted in said first contour area a greater amount than said second axis may be shifted in said second contour area.

16. The device of claim 9 wherein said first contact bridge includes a bearing leg, and wherein said first control leg engages said bearing leg when said switching slide is in said OFF position and releases said bearing leg as said switching slide is moved from said OFF position to said ON position.

17. The device of claim 9 wherein said second control leg includes a pin, said pin engages said second contact bridge in said OFF position, and, when said switching slide is moved from said OFF position to said ON position, said second axis is displaced and said pin releases said second contact bridge.

18. The device of claim 9 wherein said housing includes a contour area, said second control leg includes a pin, and said second pivoting element is pivotable about said pin as said pin passes through a dead center position defined between said first and second axes.

* * * * *

UNITED STATES PATENT AND TRADEMARK OFFICE

CERTIFICATE OF CORRECTION

PATENT NO. : 6,046,419

DATED : April 4, 2000

INVENTOR(S) : Peter Krebs

It is certified that error appears in the above-identified patent and that said Letters Patent is hereby corrected as shown below:

In the title, SWITCH WITH SEQUENTIALLY OPERATED CONTRACTS
Delete "CONTRACTS" and replace with -- CONTACTS --

In Column 1, line 8
Delete "an and off" and replace with -- on and off --

Signed and Sealed this

Fifteenth Day of May, 2001

*Attest:*

Nicholas P. Godici

NICHOLAS P. GODICI

*Attesting Officer*

*Acting Director of the United States Patent and Trademark Office*